US009239546B2

(12) United States Patent
Matsukawa et al.

(10) Patent No.: US 9,239,546 B2
(45) Date of Patent: Jan. 19, 2016

(54) DEVELOPING UNIT AND PROCESS CARTRIDGE

(71) Applicant: CANON KABUSHIKI KAISHA, Tokyo (JP)

(72) Inventors: Akihisa Matsukawa, Fuchu (JP); Takashi Hiramatsu, Tokyo (JP); Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/426,855

(22) PCT Filed: Aug. 28, 2013

(86) PCT No.: PCT/JP2013/005066

§ 371 (c)(1),
(2) Date: Mar. 9, 2015

(87) PCT Pub. No.: WO2014/038155

PCT Pub. Date: Mar. 13, 2014

(65) Prior Publication Data

US 2015/0227083 A1 Aug. 13, 2015

(30) Foreign Application Priority Data

Sep. 10, 2012 (JP) ..... 2012-198528
Jul. 30, 2013 (JP) ..... 2013-157584

(51) Int. Cl.

| | |
|---|---|
| ***G03G 15/08*** | (2006.01) |
| ***G03G 15/09*** | (2006.01) |
| ***G03G 21/18*** | (2006.01) |

(52) U.S. Cl.
CPC ..... *G03G 15/0891* (2013.01); *G03G 15/0808* (2013.01); *G03G 21/18* (2013.01)

(58) Field of Classification Search
CPC ..... G03G 15/0891; G03G 21/18; G03G 15/0808; G03G 15/09
USPC ..... 399/265, 272, 276, 279, 281, 286
See application file for complete search history.

(56) References Cited

U.S. PATENT DOCUMENTS 7,885,583 B2 * 2/2011 Shigehiro ..... 399/272

FOREIGN PATENT DOCUMENTS

JP H05-281849 A 10/1993

* cited by examiner

*Primary Examiner* — Hoang Ngo
(74) *Attorney, Agent, or Firm* — Canon USA Inc. IP Division

(57) ABSTRACT

The present invention relates to a developing unit including a developer bearing member configured to bear a developer, the axis of the developer bearing member being inclined with respect to the axis of an image bearing member. The developing unit includes a developer accommodating chamber that accommodates the developer; and a conveying member provided in the developer accommodating chamber and supplying the developer from the developer accommodating chamber to the developer bearing member by rotation. The axis of the conveying member is inclined with respect to the axis of the developer bearing member. The developer conveying force of the conveying member differs depending on the position in the axial direction thereof and increases as the distance from the axis of the conveying member to the surface of the developer bearing member increases.

20 Claims, 10 Drawing Sheets

DEVELOPING UNIT AND PROCESS CARTRIDGE

TECHNICAL FIELD

The present invention relates to a developing unit and a process cartridge for use in an image forming apparatus.

BACKGROUND ART

Electrophotographic image forming apparatuses, such as a copying machine and a laser beam printer, emit light corresponding to image data to an electrophotographic photosensitive member (photosensitive member) to form an electrostatic image (latent image). Electrophotographic image forming apparatuses supplies toner or developer, which is a recording material, from a developing unit to the electrostatic image to form a toner image. This toner image is transferred from the photosensitive member to a recording medium, such as recording paper, with a transfer unit. The toner image is fixed on the recording medium by a fixing unit to form a recorded image.

For developing units using a dry one-component developing method, various apparatuses are proposed. One example is as follows: A one-component developer (toner) is placed on a developing sleeve (developing roller) serving as a developer bearing member to form a uniform toner layer by using a layer-thickness controlling member. This developing sleeve is brought into contact with a photosensitive drum serving as an image bearing member. Then, a developing bias voltage composed of, for example, a direct-current component, is applied to the developing sleeve to cause a potential difference between an electrostatic image on the photosensitive member and the developing sleeve. Thus, the toner is transferred to the electrostatic image to form a visible image.

If a developing unit is reduced in size to make the apparatus compact, also the diameter of the developer bearing member need to be decreased. Thus, decreasing the diameter of the developer bearing member may deflect the developer bearing member to cause variations in print density between the ends and the center of paper. Furthermore, the deflection of the developer bearing member will cause a greater pushing force at the ends than the center, and thus, the ends of the image bearing member in contact with the developer bearing member may be significantly worn out.

Thus, a configuration in which the central axis of the developer bearing member is inclined with respect to the central axis of the image bearing member is proposed as a measure against such deformation of the developer bearing member, as disclosed in PTL 1. This configuration allows the developer bearing member to be kept contact with the image bearing member along the longitudinal direction thereof even if the developer bearing member deflects.

CITATION LIST

Patent Literature

PTL 1: Japanese Patent Laid-Open No. 05-281849

SUMMARY OF INVENTION

Technical Problem

However, the above developing unit in which the developer bearing member and the image bearing member are at skew positions has the following problem. When only the developer bearing member is tilted into contact with the image bearing member, it is difficult to supply toner uniformly along the length of the developer bearing member. This is because a conveying member that conveys toner to the developer bearing member by rotation is inclined with respect to the developer bearing member. In other words, since the shorted distance between a stirring member and the developer bearing member differs depending on the longitudinal position of the developer bearing member, toner is nonuniformly supplied along the length of the developer bearing member, which may cause an image defect, such as uneven density.

In particular, in the case of a configuration in which the central axis (axis) of the conveying member is lower in the direction of gravity than the central axis (axis) of the developer bearing member, and toner is conveyed upward by a conveying member, the amount of toner supplied tends to be nonuniform along the length of the developer bearing member. This can cause image defects.

Thus, the entire developing unit can be disposed in a posture inclined with respect to the image bearing member. This can make the central axes of the conveying member and the developer bearing member parallel to each other, thus solving the problem that the shortest distance between the conveying member and the developer bearing member changes depending on the longitudinal position.

However, inclining the entire developing unit with respect to the axis of the image bearing member results in also a developer container in which toner is contained being inclined with respect to the axis of the image bearing member. Since the axis of the image bearing member is generally disposed horizontally, the toner in the developer container may be biased because the bottom surface of the developer container is inclined with respect to the horizontal direction. Accordingly, even if the shortest distance between the conveying member and the developer bearing member is uniform, the bias of the toner in the container will hinder supplying the toner from the conveying member to the developer bearing member uniformly in the longitudinal direction. This can cause inconsistency in toner density on the formed image.

In consideration of the above circumstances, the present invention prevents the amount of developer supplied to a developer bearing member from becoming nonuniform along the length of the developer bearing member even if the axis of the developer bearing member is inclined with respect to the axis of the conveying member and prevents uneven density.

Solution to Problem

A typical configuration for solving the above problem is a developing unit including a developer bearing member configured to bear a developer, the axis of the developer bearing member being inclined with respect to the axis of an image bearing member. The developing unit includes a developer accommodating chamber that accommodates the developer; and a conveying member provided in the developer accommodating chamber and supplying the developer from the developer accommodating chamber to the developer bearing member by rotation. The axis of the conveying member is inclined with respect to the axis of the developer bearing member. The distance from the axis of the conveying member to the axis of the developer bearing member is longer at a second end of the conveying member in the axial direction than at a first end. A developer conveying force of the conveying member is larger at the second end than at the first end.

DESCRIPTION OF EMBODIMENTS

Embodiments of the present invention will be described on the basis of the attached drawings.

First Embodiment

Figure 2:
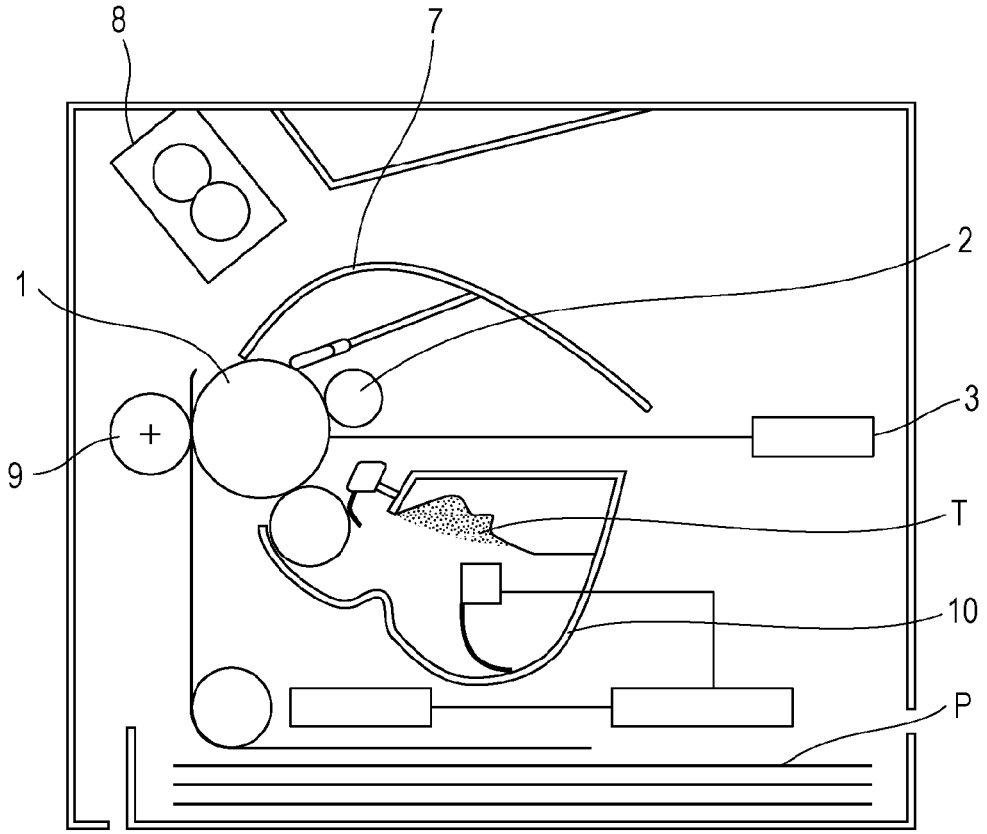
FIG. 2 is a schematic cross-sectional view of an image forming apparatus of the first embodiment.

FIG. 2 is a schematic configuration diagram of an image forming apparatus to which the present invention can be applied. A first embodiment will be described using FIG. 2. The image forming apparatus of the first embodiment is a laser printer which uses an electrophotographic system for an image forming process, and in which a process cartridge can be attached and detached.

In FIG. 2, the process cartridge includes a photosensitive drum 1 serving as an image bearing member and a charging roller 2 for uniformly charging the photosensitive drum 1. The process cartridge further includes a developing unit 10 for developing an electrostatic latent image formed on the photosensitive drum 1 with toner T by using an exposure unit 3. The process cartridge further includes a cleaning blade 7 for scraping the toner T that slightly remains on the photosensitive drum 1 after the toner image (developer image) formed on the photosensitive drum 1 is transferred to a transfer material P.

The image forming apparatus main body includes a transfer roller, which is a transfer unit 9 for transferring the toner T from the photosensitive drum 1 to the transfer material P, and a fixing unit 8 for fixing the toner T transferred to the transfer material P.

Figure 3A:
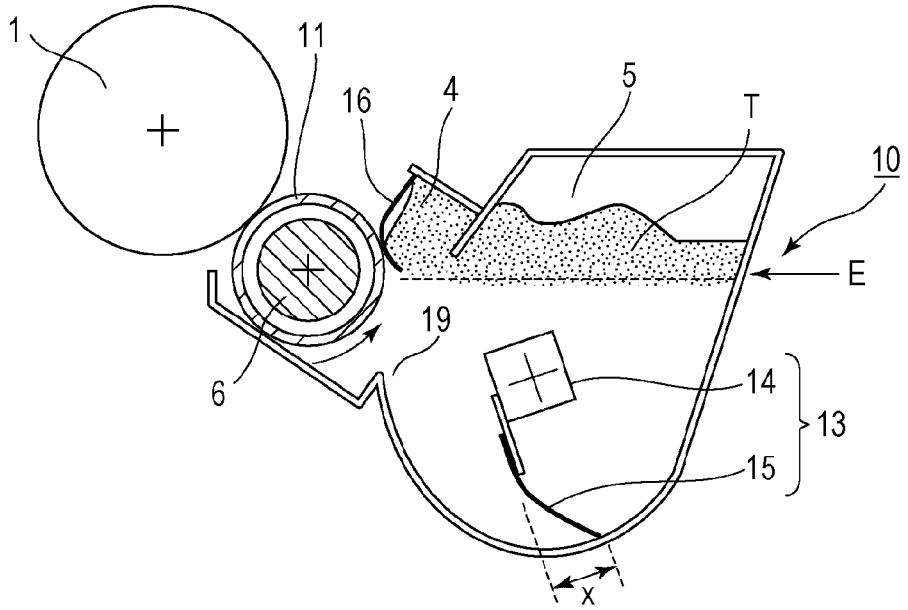
FIG. 3A is a schematic diagram of a developing unit of the first embodiment.
Figure 3B:
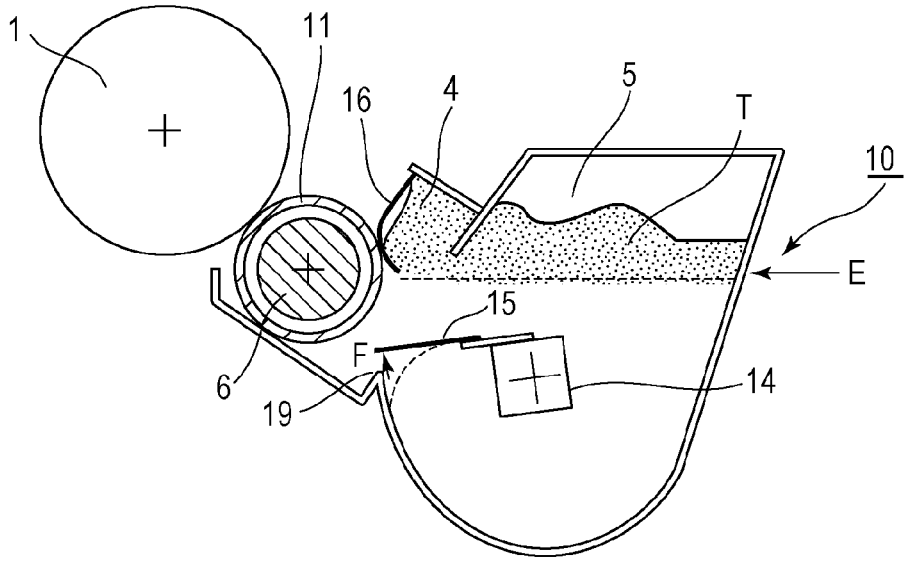
FIG. 3B is a schematic diagram of the developing unit of the first embodiment.

Next, the developing unit 10 will be described in detail using FIGS. 3A and 3B. As shown in FIGS. 3A and 3B, the developing unit 10 includes a developing chamber 4 and a developer container (developer accommodating chamber) 5. The developer container 5 accommodates the magnetic toner T and a conveying member 13 that conveys the toner T. The conveying member 13 is composed of a stirring support member 14 that is axially supported by the developer container 5 and a stirring member 15 supported by the stirring support member 14. The toner T is conveyed to the developing chamber 4 by the conveying member 13 and is developed to an image on the photosensitive drum 1. The central axis (axis) of the conveying member 13 is disposed lower in the direction of gravity than the central axis of a developing sleeve 11.

<Detailed Description of Developing Chamber 4>

The developing chamber 4 includes the developing sleeve 11 as a developing member for developing the latent image formed on the photosensitive drum 1. The developing sleeve 11 is a kind of rotatable developing roller. Specifically, the developing sleeve 11 uses a hollow aluminum pipe (sleeve) as a roller. The developing sleeve 11 is a developer bearing member that bears toner (developer) on the surface thereof. The developing sleeve 11 accommodates a magnet roller 6 in which a plurality of magnetic poles N and S are alternately formed and which is not moved relative to the developing unit 10. The magnetic toner T is attracted to the surface of the developing sleeve 11 with the magnetic force of the magnet roller 6.

Figure 4:
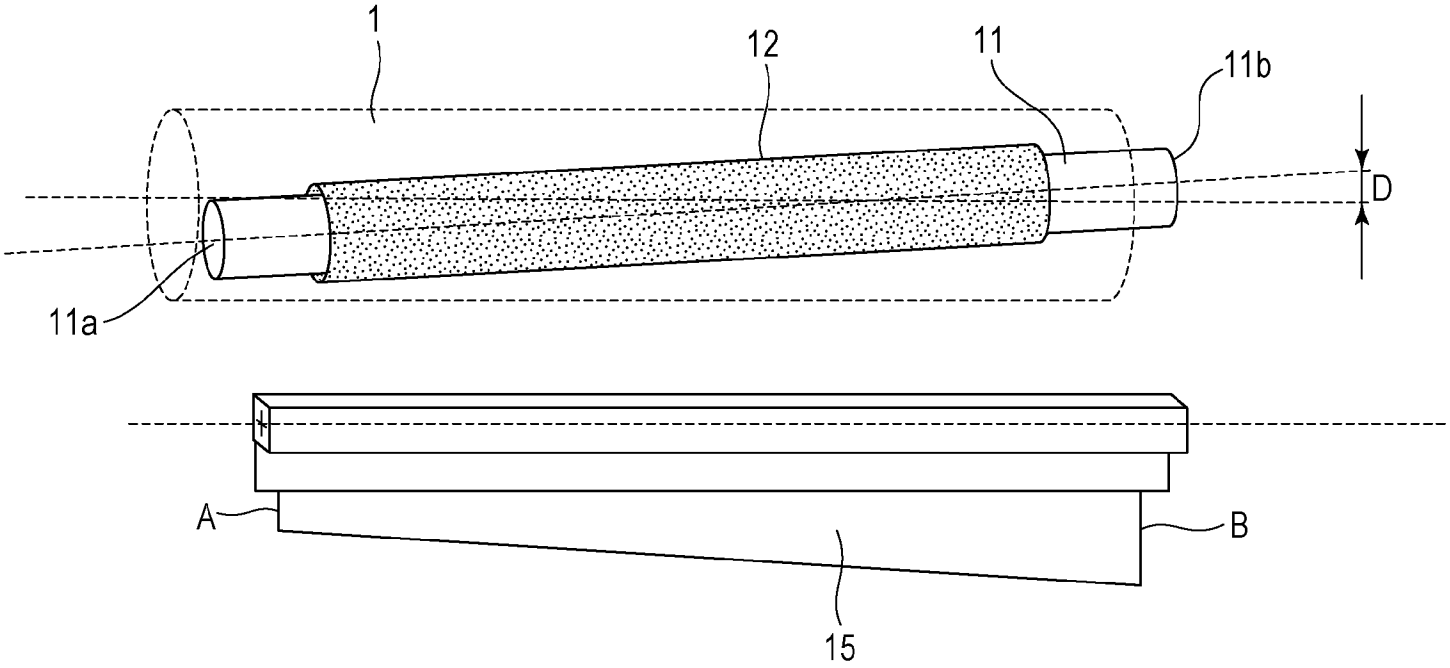
FIG. 4 is an explanatory diagram illustrating the disposition of a developing sleeve of the first embodiment.

An elastic blade 16 formed of urethane rubber is disposed as a developer control member on the developing sleeve 11. The elastic blade 16 is brought into contact with the developing sleeve 11 at a predetermined pressure. The toner T attracted to the developing sleeve 11 by the magnetic force is controlled to an appropriate amount by the elastic blade 16 that is in contact with the developing sleeve 11 and is conveyed to a developing area in which the photosensitive drum 1 and the developing sleeve 11 are in contact so as to face each other. At that time, the photosensitive drum 1 is disposed in a horizontal position and, as shown in FIG. 4, the developing sleeve 11 is disposed so that the central axis (axis) thereof is inclined at an angle of D=2 (see FIG. 4) with respect to the central axis (axis) of the photosensitive drum 1 and is in contact with the photosensitive drum 1. This allows the developing sleeve 11 to be pressed against the photosensitive drum 1 at a longitudinally uniform pressure even if the developing sleeve 11 deflects, thus reducing problems, such as separation (floating) of the developing sleeve 11 from the photosensitive drum 1. The diameter of the photosensitive drum 1 is set at 24 mm, and the developing sleeve 11 is configured such that an aluminum pipe with an outside diameter of 10 mm and an inside diameter of 9 mm is covered with a cylindrical rubber tube 12, as shown in FIG. 4.

The rubber tube 12 is made of silicon-based rubber with a thickness of 500 micrometers, an inside diameter of 9 mm, and a length of 220 mm in the longitudinal direction of the developing sleeve 11.

Next, the interior of the developer container 5 according to an embodiment of the present invention will be described using FIGS. 3A and 3B.

The developer container 5 contains the toner T and accommodates the stirring member 15 and the stirring support member 14 as a developer conveying mechanism (conveying member) 13 for conveying the toner T to the developing chamber 4. The stirring member 15 is a flexible member having flexibility against a bending stress and a sufficient elasticity restoring force against a bending stress. Specifically, the stirring member 15 is made of plastic, such as polyphenylene sulfide (PPS) or polyethylene terephthalate (PET), and is mounted to the stirring support member 14 with double-faced tape. The stirring support member 14 is composed of a shaft 14*a* that is axially supported by the developer container 5 and a supporting portion 14*b* that fixes the stirring member 15 (supports the fixed end of the stirring member 15)

Figure 1A:
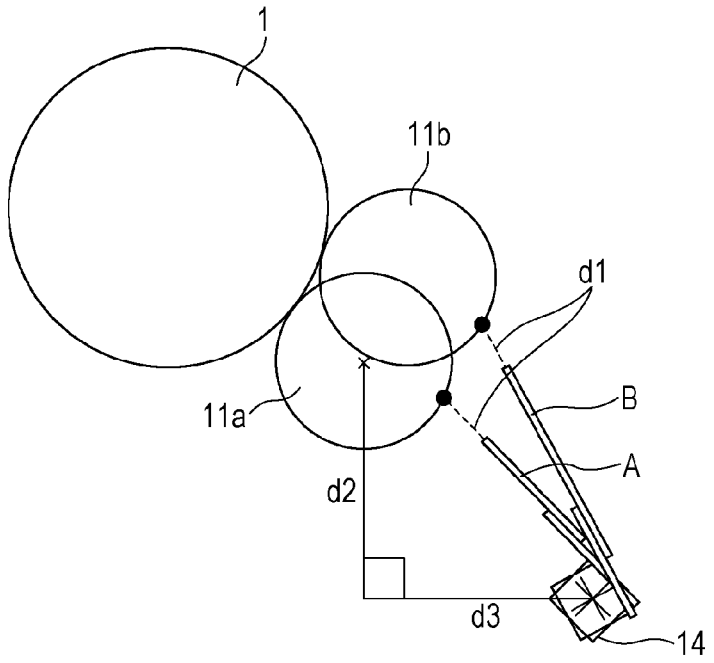
FIG. 1A is a cross-sectional view of a developing unit with a configuration of a first embodiment.
Figure 1B:
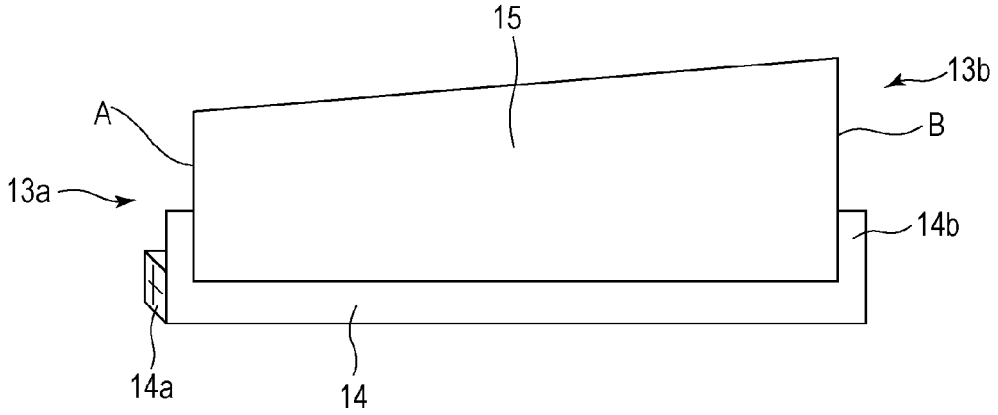
FIG. 1B is an explanatory diagram of a stirring member with the configuration of the first embodiment.

(see FIG. 1B). By the stirring support member 14 rotating about the shaft 14*a*, the stirring member 15 rotates while keeping contact with the bottom surface of the developer container 5 to supply the toner T in the developer container 5 to the developing sleeve 11 of the developing chamber 4.

In particular, the stirring member 15 of the first embodiment is configured to rotate in a deflected state by contacting with the inner wall of the developer container 5, as shown in FIG. 3A. When the distal end of the stirring member 15 reaches a deflection release point (release portion) 19, as shown in FIG. 3B, the end of the stirring member 15 is separated from the inner wall of the developer container 5, so that the stirring member 15 is released from the deflected state. The end of the stirring member 15 moves in the direction of arrow F due to the momentum of release of the deflection of the stirring member 15 (repulsive force), thus causing the toner T to splash toward the developing sleeve 11.

The axis of the conveying member 13 (the axis of the shaft 14*a*) is disposed parallel to the axis of the photosensitive drum 1. The developing sleeve 11 and the conveying member 13 are disposed so as to satisfy d2=20 mm and d3=20 mm at a second end 11*b* of the developing sleeve 11, as shown in FIG. 1A.

The axis of the developing sleeve 11 is at a position inclined with respect to the axis of the conveying member 13 (at an intersecting position). As shown in FIG. 1A, the distance between the stirring support member 14 and the developing sleeve 11 differ depending on the position of the developing sleeve 11 in the longitudinal direction (in the axial direction). Specifically, the distance between the stirring support member 14 and the developing sleeve 11 is about 28 mm at a second end 11*b* of the developing sleeve 11 (at a second end 13*b* of the conveying member 13), and about 34 mm at a first end 11*a* of the developing sleeve 11 (at a first end 13*a* of the conveying member 13). Accordingly, there is a maximum difference of 6 mm in the distance between the stirring member 15 and the developing sleeve 11 depending on the positions of the stirring support member 14 and the developing sleeve 11 in the longitudinal direction. The first ends (11*a* and 13*a*) of the developing sleeve 11 and the conveying member 13 are at positions at which the distance from the rotation center of the conveying member 13 (stirring support member 14) to the surface of the developing sleeve 11 is the shortest. On the other hand, the second ends (11*b* and 13*b*) of the developing sleeve 11 and the conveying member 13 are at positions at which the distance from the rotation center of the conveying member 13 to the surface of the developing sleeve 11 is the longest.

The first embodiment is configured such that the shortest distance between the stirring member 15 disposed on the stirring support member 14 and the surface of the developing sleeve 11 is substantially equal irrespective of the position of the developing sleeve 11 in the longitudinal direction (the axial direction of the conveying member 13). In other words, the distance from the axis of the conveying member 13 to the distal end of the stirring member 15 is changed depending on the position of the conveying member 13 in the longitudinal direction. Specifically, as shown in FIG. 1B, the length A from the stirring support member 14 to the distal end of the stirring member 15 is set to 26 mm at the first end 13*a* of the conveying member 13 in the axial direction. Furthermore, the length B from the stirring support member 14 to the distal end of the stirring member 15 is set to 32 mm at the second end 13*b* of the conveying member 13.

In other words, the distance from the axis of the conveying member 13 to the distal end of the conveying member 13 (the distal end of the stirring member 15) is set longer at the second end 13*b* than at the first end 13*a*. The distal end of the stirring member 15 has a straight shape. As a result, the length of the stirring member 15 (the length from the stirring support member 14 to the distal end of the stirring member 15) changes continuously, so that it gradually increases from the first end 13*a* to the second end 13*b*. This allows the shortest distance d1 between the surface of the developing sleeve 11 and the distal end of the stirring member 15 to be substantially uniform 2 mm along the longitudinal direction (axial direction) of the developing sleeve 11 and the conveying member 13, thus allowing the toner T to be supplied to the developing sleeve 11 uniformly in the longitudinal direction.

In other words, the toner conveying force of the conveying member 13 differs depending on the position in the longitudinal direction. The toner conveying force of the conveying member 13 is set small at the first end 13*a* close to the developing sleeve 11 and is set large at the second end 13*b* far from the developing sleeve 11. In other words, the toner conveying force of the conveying member 13 increases as the distance from the axis (rotation center) of the conveying member 13 to the surface of the developing sleeve 11 increases. As a result, the amount of toner T supplied to the developing sleeve 11 by the conveying member 13 becomes uniform in the longitudinal direction of the developing sleeve 11.

Figure 7:
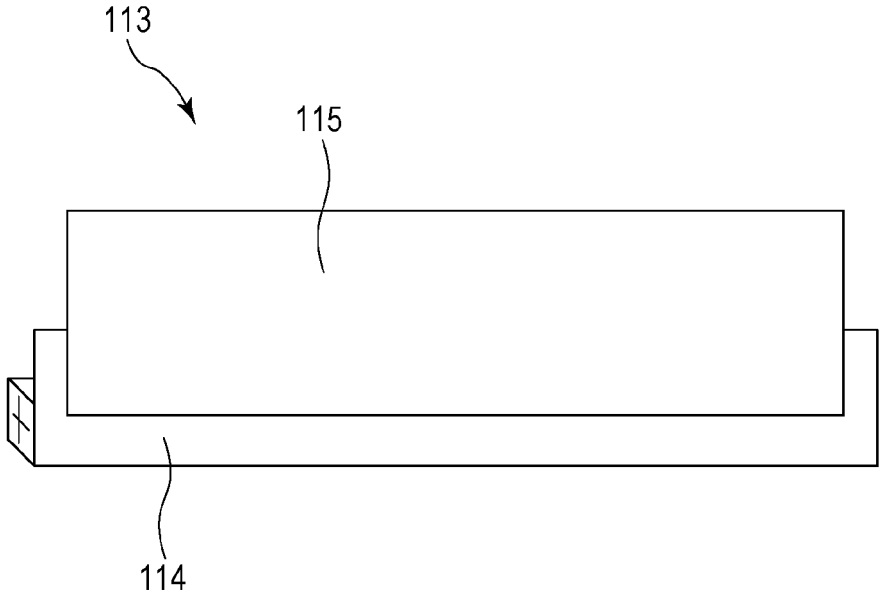
FIG. 7 is an explanatory diagram of a conveying member as a comparative example.

A comparative test was conducted between a conveying member 113 (FIG. 7), as a comparative example, having a stirring member 115 whose length in a direction perpendicular to the axis is substantially uniform, as in the related art, and the stirring member 15 (conveying member 13) of the first embodiment.

With the configuration of the conveying member 113 of the comparative example, no particular image defect was generated at the start of image formation. However, when the level of the toner T in the developer container 5 became lower than line E in FIGS. 3A and 3B as image formation was repeated, the developing sleeve 11 became exposed at the second end 11*b* from the toner T contained in the developer container 5. At that time, unevenness in density began to occur on the formed image and gradually increased as the toner T was consumed. This is because the distance between the stirring member 115 and the developing sleeve 11 differs by about 6 mm at the maximum depending on the position in the longitudinal direction (axial direction) of the developing sleeve 11. In other words, this is because the amount of toner T conveyed by the stirring member 115 differs between the first end 11*a* and the second end 11*b* of the developing sleeve 11. This caused unevenness in the density of the formed image.

In contrast, with the stirring member 15 of the first embodiment, no image defect was generated even if image formation was continued for a long period of time, and thus a high-quality image could be formed. In other words, the use of the stirring member 15 of the first embodiment allows even the developing sleeve 11 that is not parallel to the axis of the conveying member 13 to be supplied with the toner T in the developer container 5 uniformly in the longitudinal direction, thus providing a high-quality image.

Figure 8:
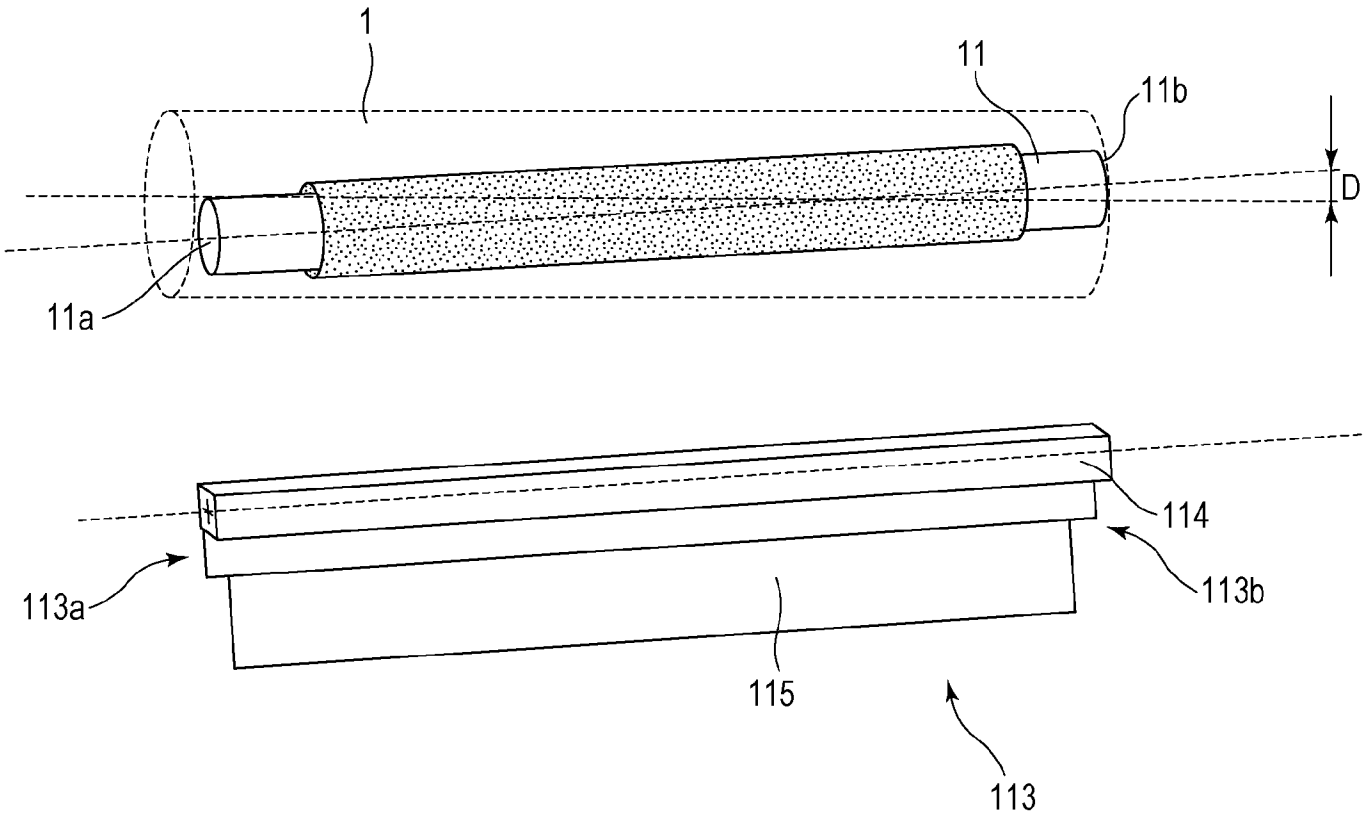
FIG. 8 is an explanatory diagram of the conveying member as a comparative example.

Also with the conveying member 113 of the comparative example, setting the axis of the conveying member 113 (the axis of a stirring support member 114) parallel to the axis of the developing sleeve 11, as in FIG. 8, can make the distance from the distal end of the stirring member 115 to the developing sleeve 11 substantially uniform. However, this poses the following problem and does not offer the advantages of the first embodiment. Specifically, with the configuration shown in FIG. 8, the axis of the conveying member 113 inclines with respect to the horizontal direction, so that the moving direction of the toner T conveyed by the stirring member 115 is inclined with respect to the direction of gravity. This makes it difficult to convey a sufficient amount of toner T to the developing sleeve 11 from, among a first end 113*a* and a second end 113*b* of the stirring member 113, the higher second end 113*b*.

Furthermore, inclining the axis of the conveying member 113 with respect to the horizontal direction will also incline an area in which the stirring member 115 passes. This produces an area, in the developer container 5, in which the toner T cannot be stirred by the stirring member 115. This hinders efficient consumption of the toner T contained in the developer container 5. If not only the conveying member 113 but also the developer container 5 are inclined in the same direction, an area in which the toner T cannot be stirred by the stirring member 115 is not produced in the developer container 5. However, in this case, the bottom of the developer container 5 is also inclined, so that the toner T contained in the developer container 5 is also biased. This may make the amount of toner T conveyed from the conveying member 113 to the developing sleeve 11 nonuniform in the longitudinal direction of the developing sleeve 11.

Furthermore, inclining the axis of the conveying member 113 with respect to the horizontal direction will increases the width of an area in the horizontal direction in which the stirring member 115 passes, thus raising the need to increase also the width of the developer container 5.

Thus, the axis of the conveying member is not greatly inclined with respect to the horizontal direction (the axial direction of the photosensitive drum 1). With the configuration of the first embodiment (FIGS. 3A and 3B), there is no need to greatly incline the axis of the conveying member 13 with respect to the axial direction of the photosensitive drum 1, thus allowing the developer to be stably conveyed toward the developing sleeve 11.

Figure 9A:
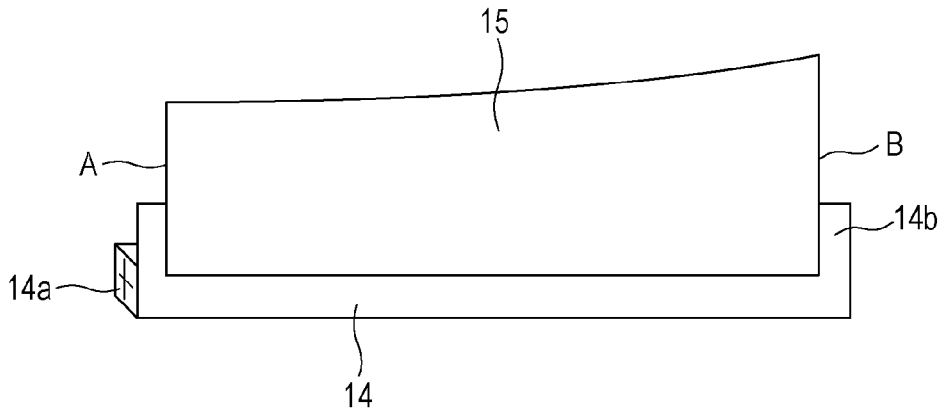
FIG. 9A is a diagram of a modification example of a conveying member of the first embodiment.
Figure 9B:
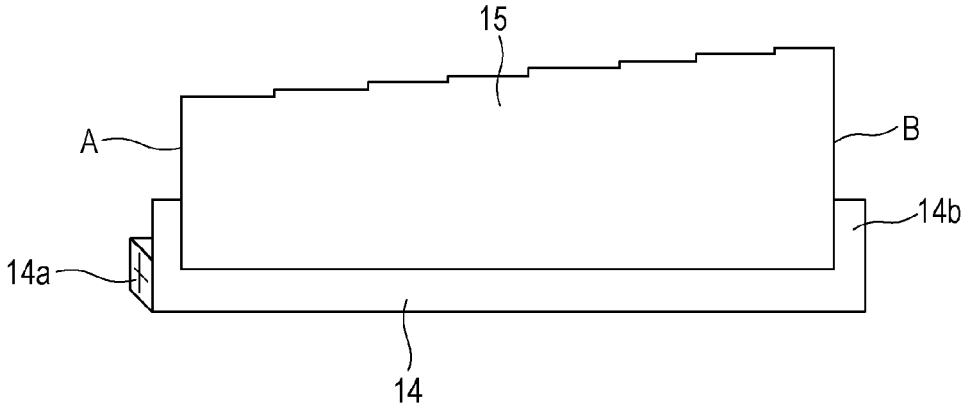
FIG. 9B is a diagram of a modification example of a conveying member of the first embodiment.

FIGS. 9A and 9B show modification examples of the first embodiment. In the first embodiment, the distal end of the stirring member 15 is straight in shape; alternatively, it may be curved as shown in FIG. 9A. The length of the stirring member 15 is continuously increased from the first end 13*a* to the second end 13*b* of the conveying member 13; alternatively, it may be intermittently increased as shown in FIG. 9B.

In other words, the shape of the stirring member 15 can be changed provided that the toner conveying force of the conveying member 13 increases as the distance between the rotation center of the conveying member 13 to the developing sleeve 11 increases.

Second Embodiment

In a second embodiment, the shapes of the stirring member 15 and the stirring support member 14 differ from those of the first embodiment, and the difference will be described in detail below using FIGS. 5A and 5B. Since configurations other than those of the stirring member 15 and the stirring support member 14 are the same as those of the first embodiment, descriptions thereof will be omitted.

In the first embodiment, by setting the distance between the developing sleeve 11 and the distal end of the stirring member 15 substantially uniform along the length of the developing sleeve 11, supply of the toner T to the developing sleeve 11 is made uniform in the longitudinal direction. In contrast, in the second embodiment, by changing the thickness of the stirring member 15 or the length of the stirring support member 14 depending on the position in the longitudinal direction of the conveying member 13, the repulsive force of the stirring member 15 that repulses the toner T is changed depending on the longitudinal position.

In other words, the force of the stirring member 15 that repulses the toner T is increased at a position where the distance between the developing sleeve 11 and the stirring member 15 is long, and the force of the stirring member 15 that repulses the toner T is decreased at a position where the distance between the developing sleeve 11 and the stirring member 15 is short, so that the amount of toner T supplied from the stirring member 15 to the developing sleeve 11 is made uniform along the length of the developing sleeve 11.

Changing the thickness of the stirring member 15 depending on the longitudinal position will be described hereinbelow. As shown in FIG. 5B, by setting the thickness of the stirring member 15 large at a position where the distance between the stirring member 15 and the developing sleeve 11 is long and by setting it small at a position where the distance is short, the amount of toner T supplied is made uniform along the length of the developing sleeve 11. Specifically, as shown in FIG. 5B, the thickness of the stirring member 15 is changed depending of the longitudinal position, that is, it is set to 50 micrometers at the first end 13*a* of the conveying member 13 and is set to 150 micrometers at the second end 13*b* of the stirring member 15. The thickness of the stirring member 15 is gradually increased from the first end 13*a* to the second end 13*b*. In other words, the thickness of the stirring member 15 is increased as the distance from the axis (rotation center) of the conveying member 13 to the surface of the developing sleeve 11 increases.

As a result, when the stirring member 15 that is rotating while keeping contact with the bottom of the developer container 5 passes through the deflection release point (release portion) 19, the repulsive force (restoring force) of the stirring member 15 that releases the deflection increases at the second end 13*b* of the conveying member 13 at which the stirring member 15 is thick. In contrast, the repulsive force of the stirring member 15 decreases at the first end 13*a* of the conveying member 13 at which the stirring member 15 is thin. In other words, the repulsive force increases as the distance from the axis (rotation center) of the conveying member 13 to the surface of the developing sleeve 11 increases. Accordingly, the force of the stirring member 15 that supplies the toner T (conveying force) decreases at a position where the distance between the developing sleeve 11 and the stirring member 15 is short (the first end 13*a*) and increases at a position where it is long (the second end 13*b*). This allows the toner T to be supplied substantially uniformly along the length of the developing sleeve 11.

Next, changing the length (distance) from the axis to the distal end of the stirring support member 14 depending on the position in the axis direction will be described.

Figure 5A:
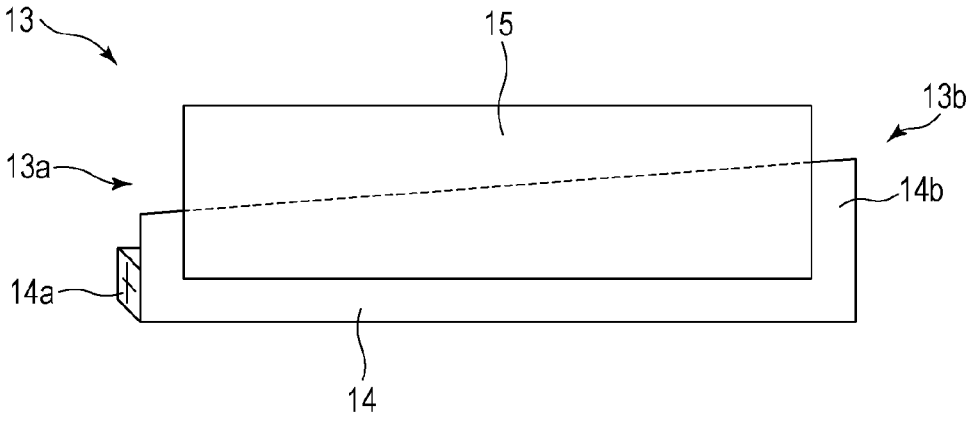
FIG. 5A is an explanatory diagram of a stirring member of the configuration of a second embodiment.
Figure 5B:
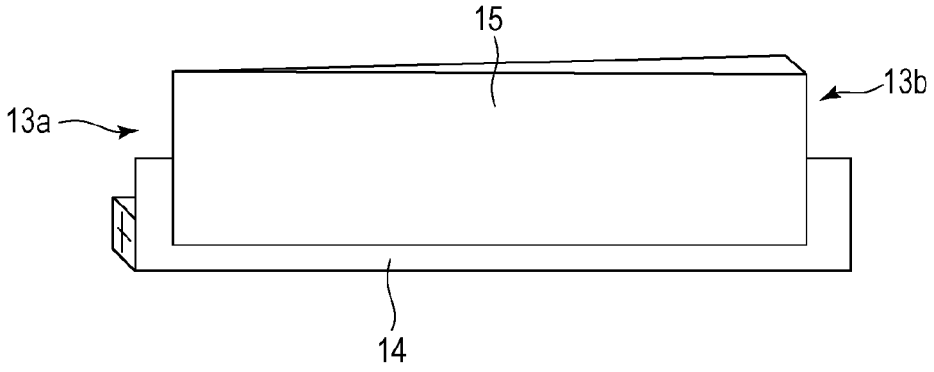
FIG. 5B is an explanatory diagram of a stirring support member of the configuration of the second embodiment.

Here, as shown in FIG. 5A, the distance (length) from the shaft 14*a* (the axis of the conveying member 13) to the distal end of the supporting portion 14*b* is set long at a position where the distance between the stirring member 15 and the developing sleeve 11 is long. In other words, the distance between the distal end of the stirring support member 14 (the supporting portion 14*b*) and the deflection release point 19 is set short. By setting the supporting portion 14*b* of the stirring support member 14 short at a position where the distance between the stirring member 15 and the developing sleeve 11 is short, the distance between the end of the stirring support member 14 (supporting portion 14*b*) and the deflection release point 19 is increased. In other words, the length of the supporting portion 14*b* is increased as the distance from the axis (rotation center) of the conveying member 13 to the surface of the developing sleeve 11 increases. With such a configuration, a position serving as a fulcrum of the deflection of the stirring member 15 (the distal end of the supporting portion 14*b*) can be changed, so that the repulsive force of the stirring member 15 can be controlled depending on the longitudinal position.

Specifically, by changing the length of the supporting portion 14*b*, the free length of the stirring member 15 (the length of an area in which the stirring member 15 can deflect measured in a direction perpendicular to the axis of the conveying member 13, the same shall apply to the following) can be 26 mm at the first end 13*a* of the conveying member 13 (the first end 11*a* of the developing sleeve 11), and the free length of the stirring member 15 can be 20 mm at the second end 13*b* of the conveying member 13 (the second end 11*b* of the developing sleeve 11).

The amounts of deflection (amount of deformation) X of the conveying member 13 when the stirring member 15 rotates (see FIG. 3A) are substantially the same at the first end 13*a* and the second end 13*b* of the conveying member 13. Therefore, the repulsive force of the stirring member 15 when the deflection is released is larger as the free length of the stirring member 15 decreases. In other words, the repulsive force of the stirring member 15 is larger at the second end 13*b* at which the free length of the stirring member 15 is short than at the first end 13*a* at which the free length of the stirring member 15 is long.

As a result, the force of the stirring member 15 that conveys the toner T is smaller at a position where the distance between the developing sleeve 11 and the stirring member 15 is short (the first end 13*a*) and is larger at a position where the distance is long (the second end 13*b*). This allows the conveying member 13 to supply the toner T substantially uniformly along the length of the developing sleeve 11. In other words, by decreasing the force of the conveying member 13 that conveys the toner T at the first end 13*a* and increasing it at the second end 13*b*, ununiformity in the amount of toner T supplied to the developing sleeve 11 is prevented.

Third Embodiment

In a third embodiment, the developing unit 10 is provided with a developer supply member (supply roller 18) in addition to the configuration of the first embodiment. The developing unit 10 will be described in detail using FIG. 6. The same configuration as that of the first embodiment will be omitted.

Figure 6:
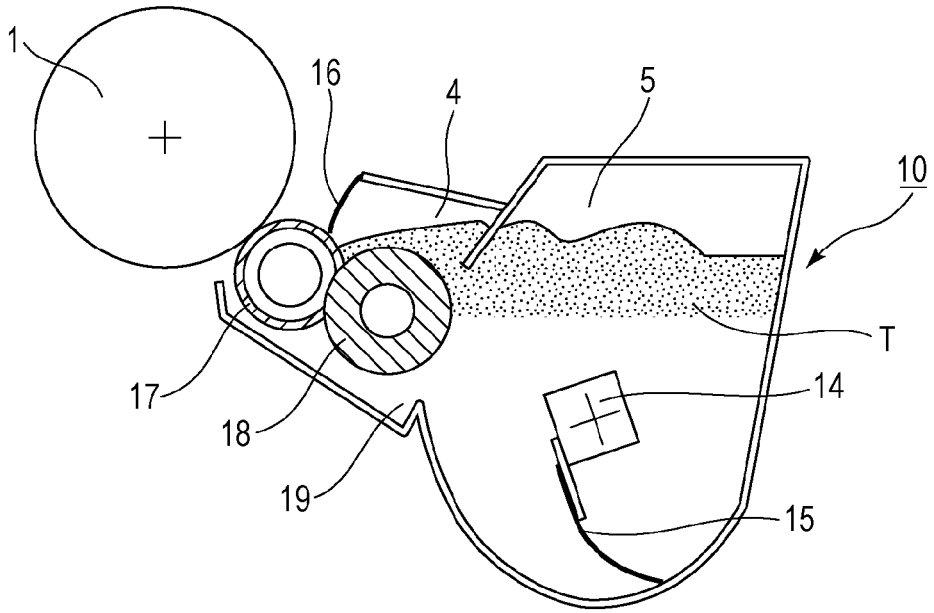
FIG. 6 is an explanatory diagram of a developing unit of a third embodiment.

As shown in FIG. 6, the developing unit 10 is composed of the developing chamber 4 and the developer container 5. The developer container 5 accommodates nonmagnetic toner T and the conveying member 13 composed of the stirring member 15 and the stirring support member 14. The toner T is conveyed to the supply roller 18 of the developing chamber 4 by the stirring member 15 rotated by the stirring support member 14. Thereafter, the toner T moves from the supply roller 18 to a developing roller 17 and transfers from the developing roller 17 to the photosensitive drum 1, where the latent image on the photosensitive drum 1 is developed.

<Detailed Description of Developing Chamber 5>

The developing chamber 4 includes the developing roller 17 formed by wrapping a core metal (metal shaft) with electrically conductive rubber, as shown in FIG. 6. In the third embodiment, the developing roller 17 is a developer bearing member that bears toner (developer) T on the surface thereof and serves as a developing member that develops the latent image formed on the photosensitive drum 1. The elastic blade 16 formed of steel special use stainless (SUS) is provided, as a developer control member, on the developing roller 17 and is in contact with the developing roller 17 under a predetermined pressure. The supply roller 18 for supplying the toner T to the developing roller 17 is in pressure-contact with the developing roller 17 in such a manner as to enter the developing roller 17 by 300 micrometers. The supply roller 18 is a second developer bearing member that bears the toner (developer) T on the surface thereof and also serves as a developer supply roller that supplies the toner (developer) T to the developing roller (developing member) 17.

The toner T supplied from the supply roller 18 to the developing roller 17 is controlled to an appropriate amount by the elastic blade 16 that is in contact with the developing roller 17 and is conveyed to a developing area in which the photosensitive drum 1 and the developing roller 17 are opposite and in contact. The photosensitive drum 1 is disposed parallel to the ground (in a horizontal position), and the developing roller 17 and the supply roller 18 are in contact with each other at an angle of D=2 degrees in the direction perpendicular to the central axis of the photosensitive drum 1 (see FIG. 4). This allows the developing roller 17 to be pushed against the photosensitive drum 1 at a uniform pressure along the longitudinal direction thereof even if the developing roller 17 deflects, thus making it prone to problems, such as the developing roller 17 being separated (floating) from the photosensitive drum 1.

However, with the configuration of the third embodiment, as described above, the interval (distance) between the stirring member 15 and the supply roller 18 differs depending on the longitudinal position of the supply roller 18. Differences in the amount of toner T supplied from the stirring member 15 to the supply roller 18 depending on the longitudinal position of the supply roller 18 will change the amount of toner T supplied to the developing roller 17 depending on the longitudinal position of the developing roller 17, thus posing the possibility of image defect, such as unevenness of density, in the formed image.

Therefore, the third embodiment is configured such that the distance from the distal end of the stirring member 15 to the supply roller 18 is uniform irrespective of the longitudinal position thereof. In other words, the third embodiment offers the same advantages as those of the first embodiment by changing the distance from the axis of the conveying member 13 (the stirring support member 14) to the distal end of the stirring member 15 depending on the longitudinal position of the supply roller 18.

Also in the third embodiment, the thickness of the stirring member 15 may be changed depending on the longitudinal position, or the length of the stirring support member 14 (the length perpendicular to the axis) may be changed depending on the longitudinal position of the stirring support member 14, as in the second embodiment.

Fourth Embodiment

Figure 10:
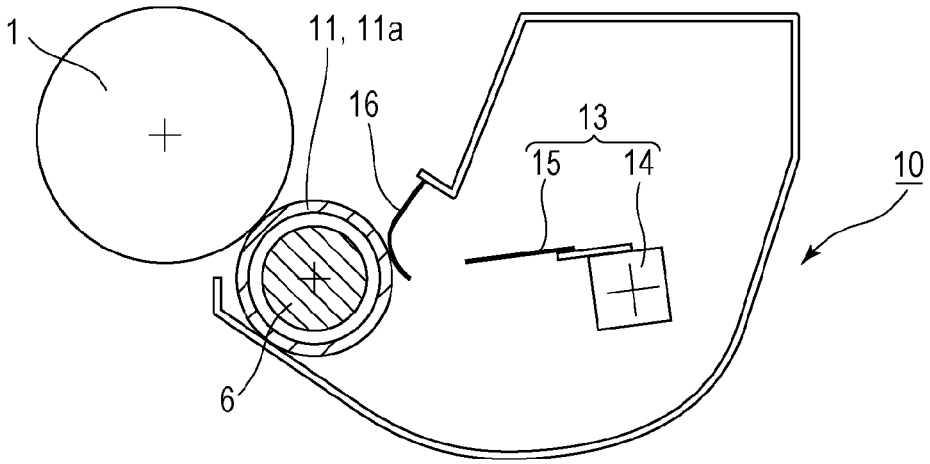
FIG. 10 is an explanatory diagram of a developing unit of a fourth embodiment.
Figure 11A:
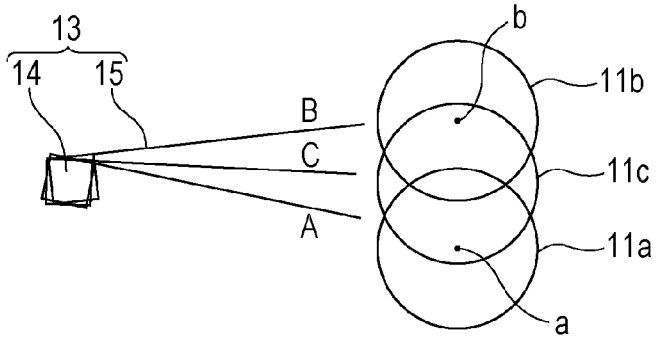
FIG. 11A is an explanatory diagram of a conveying member of the fourth embodiment.

In a fourth embodiment, a configuration in which the disposition of the developing roller 11 and the conveying member 13 is changed from the first embodiment will be described using FIGS. 10, 11A, and 11B. The same configuration as that of the first embodiment will be omitted.

In the first embodiment described above, the entire developing roller 11 is located higher than the axis of the conveying member 13 (the stirring support member 14). In contrast, in the fourth embodiment, the center a of the first end 11*a* in the longitudinal direction of the developing roller 11 is located lower than the axis of the conveying member 13 (the stirring support member 14), as shown in FIG. 11A. The center b of the second end 11*b* is located higher than the axis of the conveying member 13 (the stirring support member 14). As shown in FIG. 10, a central portion 11*c* of the developing roller 11 in the longitudinal direction (a portion between the first end 11*a* and the second end 11*b*) is located at the same height as the rotation axis of the conveying member 13 (the stirring support member 14).

At that time, the central portion 11*c* of the developing roller 11 is located closer to the stirring support member 14 than the first end 11*a* and the second end 11*b* of the developing roller 11. In other words, the distance between the surface of the developing roller 11 and the axis of the conveying member 13 is the shortest at the central portion 11*c* and 13*c* of the developing roller 11 and the conveying member 13 and is the longest at the first ends 11*a* and 13*a* or the second ends 11*b* and 13*b* of the developing roller 11 and the conveying member 13.

Figure 11B:
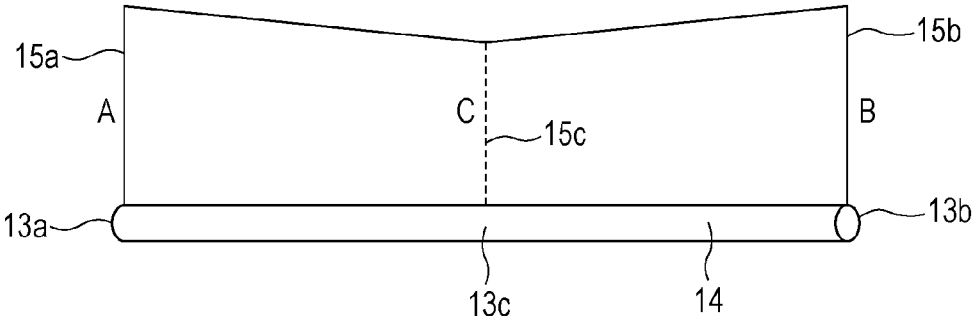
FIG. 11B is an explanatory diagram of the conveying member of the fourth embodiment.

Therefore, in the fourth embodiment, to make the conveying member 13 convey the toner T as uniformly as possible in the longitudinal direction, the stirring member 15 is set short at a central portion 15*c* in the longitudinal direction and is set long at ends 15*a* and 15*b*, as shown in FIG. 11B. In other words, the force of the stirring member 15 that conveys the toner T is decreased at the central portion 13*c* at which the distance between the centers of the conveying member 13 and the developing roller 11 is short. On the other hand, the force of the stirring member 15 that conveys the toner T is increased at the both ends 13*a* and 13*b* at which the distance between the centers of the conveying member 13 and the developing roller 11 is long.

In the fourth embodiment, the distances between the stirring support member 14 and the developing roller 11 are the same at the first end 13*a* and the second end 13*b* of the conveying member 13. Therefore, the length A of the first end 15*a* of the stirring member 15 and the length B of the second end 15*b* are set equal (A=B). The length C of the central portion 15*c* of the stirring member 15 was set shorter than A and B (C<A=B), but does not necessarily need to satisfy A=B.

In other words, the length C of the stirring member 15 at the central portion 13*c* at which the distance between the rotation center of the conveying member 13 and the developing sleeve 11 is short may be shorter than the lengths A and B at the both ends 13*a* and 13*c*. In other words, the both ends 15*a* and 15*b* of the stirring member 15 may be longer than the central portion 15*c*, that is, C<A and C<B.

In the fourth embodiment, the supply roller 18 (see FIG. 6) may be provided in the developing unit 10, as in the third embodiment.

Furthermore, in the fourth embodiment, the distances from the first end 11*a* and the second end 11*b* of the developing roller 11 to the stirring support member 14 are equal; they may differ.

The configurations of the above embodiments are summarized as follows: the configurations of the above embodiments can prevent the amount of developer supplied to the developer bearing member from becoming nonuniform along the length of the developer bearing member even if the axis of the developer bearing member is inclined with respect to the axis of the conveying member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-198528, filed Sep. 10, 2012 and No. 2013-157584 filed Jul. 30, 2013, which is hereby incorporated by reference herein in its entirety.

The invention claimed is:

1. A developing unit including a developer bearing member configured to bear a developer, the axis of the developer bearing member being inclined with respect to the axis of an image bearing member, the developing unit comprising:

a developer accommodating chamber that accommodates the developer; and a conveying member provided in the developer accommodating chamber and supplying the developer from the developer accommodating chamber to the developer bearing member by rotation, wherein the axis of the conveying member is inclined with respect to the axis of the developer bearing member; and the developer conveying force of the conveying member differs depending on the position in the axial direction thereof and increases as the distance from the axis of the conveying member to the surface of the developer bearing member increases.

2. The developing unit according to claim 1, wherein the distance from the axis of the conveying member to a distal end of the conveying member increases as the distance from the axis of the conveying member to the surface of the developer bearing member increases.

3. The developing unit according to claim 1, wherein the conveying member includes a flexible member; and a repulsive force when the deflection of the flexible member is released increases as the distance from the axis of the conveying member to the surface of the developer bearing member increases.

4. The developing unit according to claim 3, wherein the thickness of the flexible member increases as the distance from the axis of the conveying member to the surface of the developer bearing member increases.

5. The developing unit according to claim 3, wherein the conveying member has a supporting portion that supports a fixed end of the flexible member; and the distance from the axis of the conveying member to a distal end of the supporting portion increases as the distance from the axis of the conveying member to the surface of the developer bearing member increases.

6. The developing unit according to claim 1, wherein the conveying member includes a flexible member; and the developer accommodating chamber includes a release portion in which the developer is moved from the conveying member toward the developer bearing member by separating the flexible member from the inner wall of the developer accommodating chamber and by releasing the deflection of the flexible member.

7. The developing unit according to claim 1, wherein when the developing unit is used in an image forming apparatus, the axis of the developer bearing member is located higher than the axis of the conveying member.

8. The developing unit according to claim 1, wherein the distance from the axis of the conveying member to the developer bearing member is shortest at a first end of the conveying member in the axial direction and is longest at a second end of the conveying member.

9. The developing unit according to claim 1, wherein the distance from the axis of the conveying member to the developer bearing member is longest at a first end or a second end of the conveying member in the axial direction and is shortest at a position between the first end and the second end.

10. The developing unit according to claim 1, wherein the developer bearing member is a developing member that contacts with the image bearing member to develop a latent image formed on the image bearing member.

11. The developing unit according to claim 1, wherein the developing unit includes a developing member that contacts with the image bearing member to develop a latent image formed on the image bearing member; and the developer bearing member is a developer supply roller that contacts with the developing member to supply the developer to the developing member.

12. The developing unit according to claim 1, wherein the developing unit can be attached to and detached from an image forming apparatus main body.

13. A process cartridge that can be attached to and detached from an image forming apparatus main body, the process cartridge comprising:

an image bearing member on which a latent image is formed; and a developing unit including a developer bearing member configured to bear a developer, the axis of the developer bearing member being inclined with respect to the axis of the image bearing member, wherein the developing unit includes:

a developer accommodating chamber that accommodates the developer; and a conveying member provided in the developer accommodating chamber and supplying the developer from the developer accommodating chamber to the developer bearing member by rotation, wherein the axis of the conveying member is inclined with respect to the axis of the developer bearing member; and the developer conveying force of the conveying member differs depending on the position in the axial direction thereof and increases as the distance from the axis of the conveying member to the surface of the developer bearing member increases.

14. The process cartridge according to claim 13, wherein the distance from the axis of the conveying member to a distal end of the conveying member increases as the distance from the axis of the conveying member to the surface of the developer bearing member increases.

15. The process cartridge according to claim 13, wherein the conveying member includes a flexible member; and a repulsive force when the deflection of the flexible member is released increases as the distance from the axis of the conveying member to the surface of the developer bearing member increases.

16. The process cartridge according to claim 15, wherein the thickness of the flexible member increases as the distance from the axis of the conveying member to the surface of the developer bearing member increases.

17. The process cartridge according to claim 15, wherein the conveying member has a supporting portion that supports a fixed end of the flexible member; and the distance from the axis of the conveying member to a distal end of the supporting portion increases as the distance from the axis of the conveying member to the surface of the developer bearing member increases.

18. The process cartridge according to claim 13, wherein the conveying member includes a flexible member; and the developer accommodating chamber includes a release portion in which the developer is moved from the conveying member toward the developer bearing member by separating the flexible member from the inner wall of the developer accommodating chamber and by releasing the deflection of the flexible member.

19. The process cartridge according to claim 13, wherein when the developing unit is used in an image forming apparatus, the axis of the developer bearing member is located higher than the axis of the conveying member.

20. The process cartridge according to claim 13, wherein the distance from the axis of the conveying member to the developer bearing member is shortest at a first end of the conveying member in the axial direction and is longest at a second end of the conveying member.

* * * * *